US009837700B2

(12) United States Patent
Yagi et al.

(10) Patent No.: US 9,837,700 B2
(45) Date of Patent: Dec. 5, 2017

(54) ANTENNA DEVICE AND PORTABLE ELECTRONIC DEVICE

(71) Applicant: CASIO COMPUTER CO., LTD., Tokyo (JP)

(72) Inventors: Shigeru Yagi, Tokyo (JP); Youichi Ushigome, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 162 days.

(21) Appl. No.: 14/637,981

(22) Filed: Mar. 4, 2015

(65) Prior Publication Data

US 2015/0263437 A1 Sep. 17, 2015

(30) Foreign Application Priority Data

Mar. 14, 2014 (JP) ..... 2014-051415

(51) Int. Cl.
*H01Q 9/04* (2006.01)
*H01Q 1/22* (2006.01)
*H01Q 7/00* (2006.01)

(52) U.S. Cl.
CPC ..... *H01Q 1/2216* (2013.01); *H01Q 7/00* (2013.01); *H01Q 9/0428* (2013.01)

(58) Field of Classification Search
CPC ..... H01Q 21/30; H01Q 7/00; H01Q 9/0407
USPC ..... 343/866, 729, 700 MS
See application file for complete search history.

(56) References Cited

U.S. PATENT DOCUMENTS

2004/0051675 A1 3/2004 Inoue
2004/0217907 A1 11/2004 Inoue
2011/0234463 A1* 9/2011 Lankes ..... H01Q 1/2216 343/728
2014/0062827 A1* 3/2014 Kato ..... H01Q 1/38 343/856
2015/0116168 A1* 4/2015 Yosui ..... H01Q 7/00 343/722

FOREIGN PATENT DOCUMENTS

JP 2003-152445 A 5/2003
JP 2003-163531 A 6/2003

OTHER PUBLICATIONS

Section III.B of "Antenna Theory: A Review," Constantine A. Balanis, Proceedings of the IEEE, vol. 80, No. 1, Jan. 1992.*

* cited by examiner

*Primary Examiner* — Hoang Nguyen
*Assistant Examiner* — Jae Kim
(74) *Attorney, Agent, or Firm* — Chen Yoshimura LLP

(57) ABSTRACT

An antenna device of the present invention includes, in one aspect: a patch antenna having a resonant frequency at a first frequency; and a loop antenna having a resonant frequency at a second frequency that is different from the first frequency. A loop length of the loop antenna is such that standing waves are generated in the loop antenna when the loop antenna receives radio waves of the first frequency, and the patch antenna is disposed so as to magnetically couple with the loop antenna.

7 Claims, 8 Drawing Sheets

ANTENNA DEVICE AND PORTABLE ELECTRONIC DEVICE

BACKGROUND OF THE INVENTION

Field of the Invention

The present invention relates to an antenna device and a portable electronic device.

Background Art

It is known that conventional GPS (global position system) schemes measure the longitude and latitude of a current location in accordance with GPS signals in GPS radio waves, which are received from GPS satellites via a GPS antenna. One example of such a GPS antenna is a patch antenna. There are also handy terminals equipped with GPS reception units that have a GPS antenna therein, and these terminals can detect current location.

Compound antennas, which are provided with a plurality of antennas for detecting radio waves of different frequencies, are also known. Japanese Patent Application Laid-Open Publication No. 2003-152445 discloses a compound antenna that has a patch antenna for transmission and reception of ETC (electronic toll collection system) or DSRC (dedicated short-range communications) signals and that receives radio waves of two different frequencies, for example. Japanese Patent Application Laid-Open Publication No. 2003-163531 discloses a compound antenna that has a patch antenna for transmission and reception of ETC or DSRC signals, a loop antenna for GPS signals, and a loop antenna for receiving radio wave beacons. This compound antenna receives three different frequencies.

There is demand for a GPS antenna to be provided in a handy terminal having a reader/writer for RFID (radio frequency identification)/NFC (near-field communication) signals. When a plurality of antennas are provided as in Patent Documents 1 and 2, however, the GPS antenna is disposed in the vicinity of the loop antenna (antenna coil) used for RFID, and the interference between these antennas degrades antenna performance characteristics such as directionality.

On the other hand, to ensure the performance of both antennas without interference, it is necessary to install the antennas in locations that are separated from each other at approximately $\lambda/4$ of a wavelength of the frequency being used, which hinders miniaturization of the handy terminal.

SUMMARY OF THE INVENTION

The present invention aims at arranging two antennas in the vicinity of each other while increasing the antenna performance thereof.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an antenna device, including: a patch antenna having a resonant frequency at a first frequency; and a loop antenna having a resonant frequency at a second frequency that is different from the first frequency, wherein a loop length of the loop antenna is such that standing waves are generated in the loop antenna when the loop antenna receives radio waves of the first frequency, and wherein the patch antenna is disposed so as to magnetically couple with the loop antenna.

In one aspect, the present disclosure provides a portable electronic device, including: an imaging unit provided on an end of the portable electronic device; a loop antenna provided so as to surround the imaging unit; and a patch antenna that has a different resonant frequency than a resonant frequency of the loop antenna, wherein a loop length of the loop antenna is such that standing waves are generated in the loop antenna when the loop antenna receives radio waves having a frequency that corresponds to the resonant frequency of the patch antenna, and wherein the patch antenna is disposed so as to magnetically couple with the loop antenna.

The present invention makes it possible to arrange a loop antenna in the vicinity of a patch antenna and to increase antenna performance thereof, such as by enhancing a directionality of the antenna so that radio waves of the first frequency propagate in many directions.

It is to be understood that both the foregoing general description and the following detailed description are exemplary and explanatory, and are intended to provide further explanation of the invention as claimed.

DETAILED DESCRIPTION OF THE PREFERRED EMBODIMENT

Figure 1:
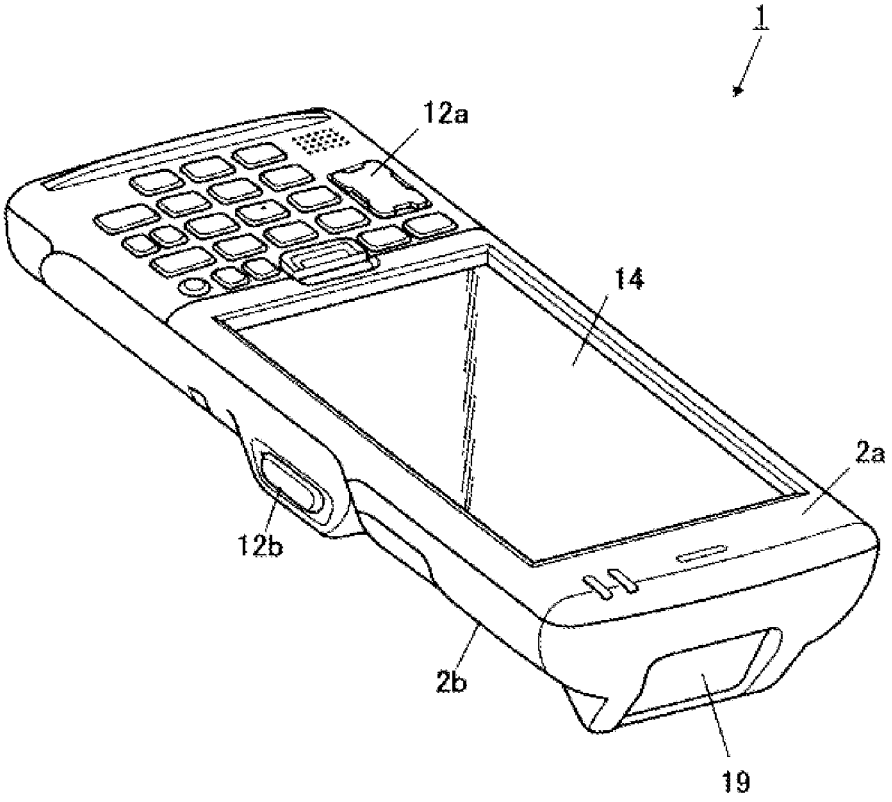
FIG. 1 is an external view of a handy terminal according to one aspect of the present invention.

An embodiment and modification example according to the present invention will be described in detail below with reference to the accompanying drawings. The present invention is not limited to the examples shown in the drawings.

An embodiment of the present invention will be described below with reference to FIGS. 1 to 8. First, a device configuration of the present embodiment will be described with reference to FIGS. 1 to 4.

FIG. 1 is an external view of a handy terminal 1 according to the present embodiment.

Figure 2:
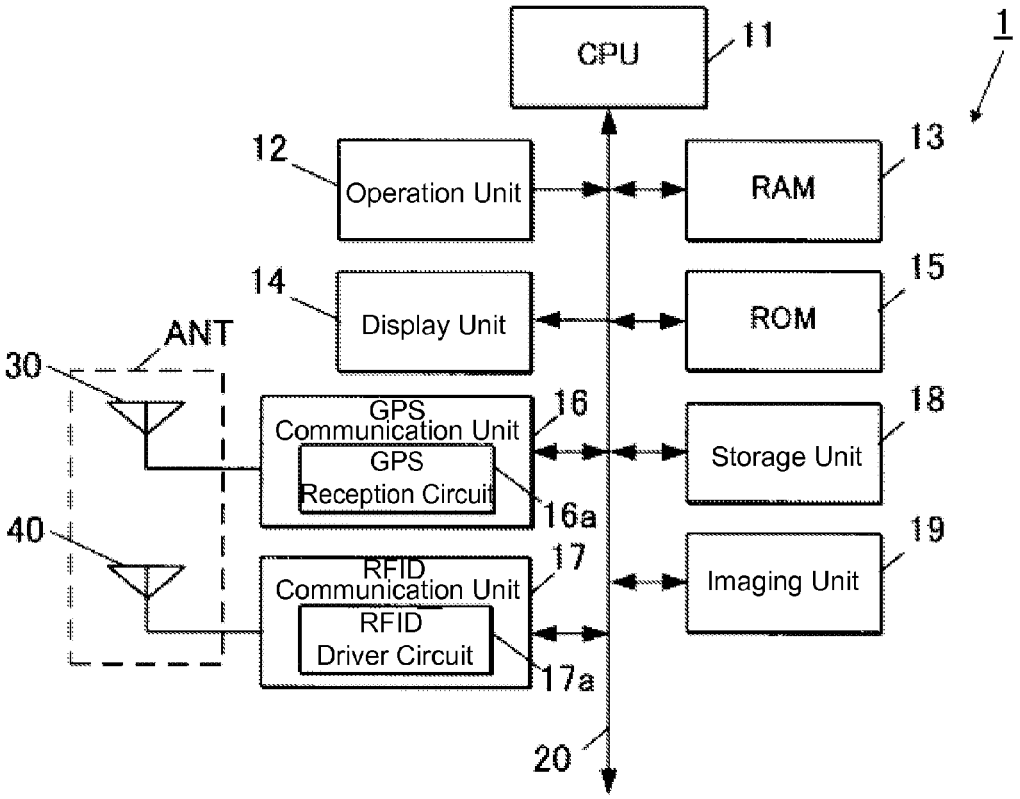
FIG. 2 is a block view of a functional configuration of the handy terminal.

FIG. 2 is a block view of a functional configuration of the handy terminal 1.

Figure 3:
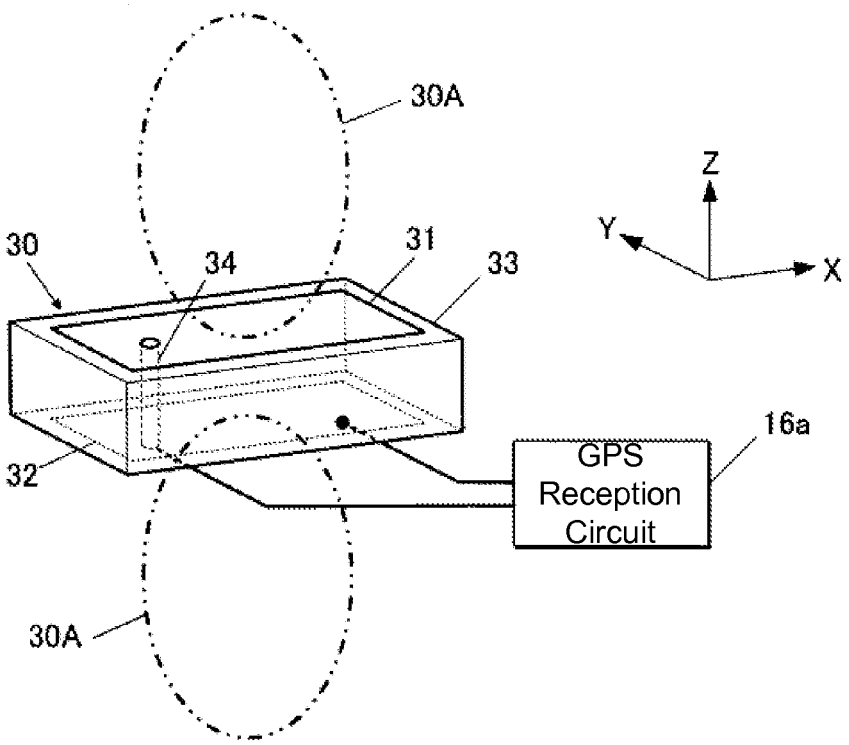
FIG. 3 is a perspective view of a patch antenna.
Figure 4:
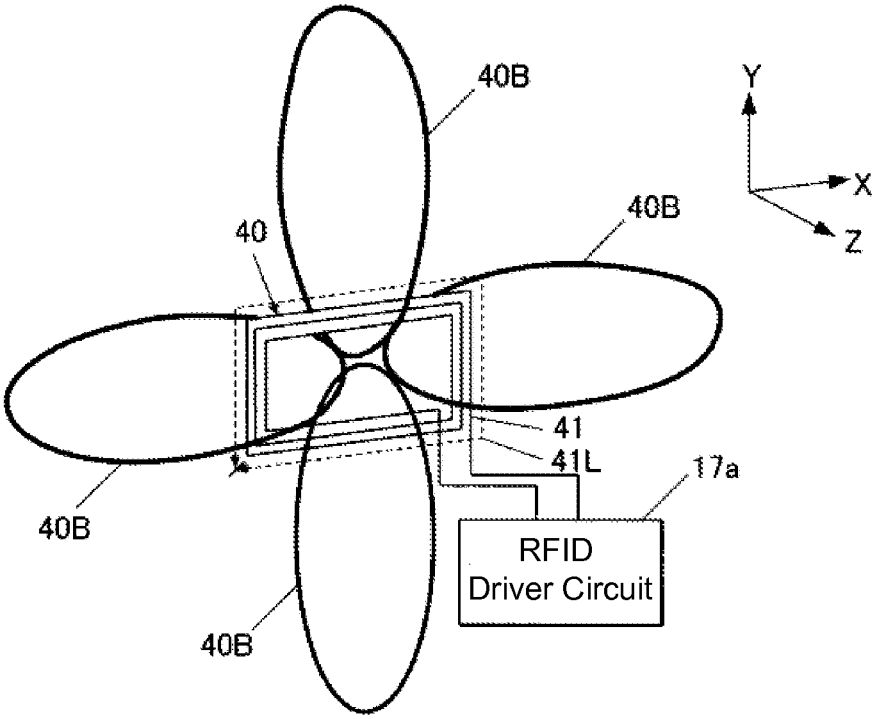
FIG. 4 is a perspective view of a loop antenna.

FIG. 3 is a perspective view of a patch antenna 30. FIG. 4 is a perspective view of a loop antenna 40.

First, the external configuration of the handy terminal 1, which is a portable electronic device of the present embodiment, will be explained with reference to FIG. 1.

The handy terminal 1 is a portable terminal that functions as a symbols reader (for one-dimensional bar codes, two-dimensional codes), an RFID reader/writer, a GPS device, and input/output device for various types of information.

The handy terminal 1 is used for item management during deliveries, inventory management, and the like, for example.

As shown in FIG. 1, the handy terminal 1 has a top case 2*a* and a bottom case 2*b*, which are made of resin, and a battery (not shown), substrate 10 (omitted in FIG. 1), and the like between the top case 2*a* and the bottom case 2*b*, i.e., inside the handy terminal 1. The substrate 10 is a PCB (printed circuit board) that has various types of circuit components mounted thereon.

The handy terminal 1 has a display unit 14 and keys 12*a* on the flat portion (the top) of the top case 2*a*. The display unit 14 is constituted of an LCD (liquid crystal display), EL (electroluminescent) display, or the like, and displays various types of information.

The keys 12*a* are constituted of a plurality of keys that receive push operations from the user, such as a menu key, letter (numeral) input keys, cursor keys, trigger keys for RFID reading/writing, and the like.

The handy terminal 1 has an imaging unit 19 at the tip of the bottom case 2*b*. The imaging unit 19 has an optical system that captures an image of an object and outputs image data, an imaging device, and a processing circuit. In particular, the imaging unit 19 captures the object as symbols, and performs imaging for reading the information of these symbols.

The handy terminal 1 has side keys 12*b* on both sides of the bottom case 2*b*. The side keys 12*b* are trigger keys for RFID reading/writing.

Next, the functional configuration of the handy terminal 1 will be explained with reference to FIG. 2. The respective constituting elements in FIG. 2 are mounted on the substrate 10 and connected to each other.

As shown in FIG. 2, the handy terminal 1 includes a CPU (central processing unit) 11, operation unit 12, RAM (random access memory) 13, display unit 14, ROM (read only memory) 15, patch antenna 30, loop antenna 40, a GPS communication unit 16 as a first communication unit, a RFID communication unit 17 as a second communication unit, storage unit 18, and an imaging unit 19.

The respective units of the handy terminal 1 are connected by a bus 20. An antenna device ANT has the patch antenna 30 and the loop antenna 40.

The CPU 11 controls the respective units of the handy terminal 1. The CPU 11 reads designated system programs and application programs stored in the ROM 15 and executes various types of processes in cooperation with these programs.

The operation unit 12 has the keys 12*a* and the side keys 12*b*, which respectively receive push input from the user. The operation information from this push input is outputted to the CPU 11. The operation unit 12 may include a touch panel integrally formed with the display unit 14.

The RAM 13 is a volatile memory that has a work area for temporarily storing various types of data and programs. The display unit 14 performs various types of display in accordance with display information received from the CPU 11. The ROM 15 is a read-only memory that stores various types of data and programs.

The patch antenna 30 is a receiver antenna for GPS radio waves, and has a resonant frequency f1 of 1.5754 GHz. The GPS communication unit 16 is a reception unit that receives GPS radio waves from the GPS satellites through the patch antenna 30 and obtains the GPS signals in these GPS radio waves.

The GPS communication unit 16 has a GPS reception circuit 16*a*.

The GPS reception circuit 16*a* processes GPS radio wave-induced antenna current received from the patch antenna 30, and has a demodulating circuit, amp, signal processing circuit, and the like.

The CPU 11 calculates longitudinal and latitudinal position information of the handy terminal 1 in accordance with the GPS signals received from the GPS communication unit 16 via the patch antenna 30. The CPU 11 detects positions in accordance with these calculations.

The loop antenna 40 is a coil antenna for RFID communication and has a resonant frequency f2 of 13.56 MHz.

The RFID communication unit 17 performs short-range communication with RFID tags, RFID IC cards, and the like.

The RFID communication unit 17 has an RFID driver circuit 17*a*.

The RFID driver circuit 17*a* generates antenna current to be sent to the loop antenna 40 and processes antenna current received from the loop antenna 40. The RFID driver circuit 17*a* has a modulation/demodulation circuit, amp, signal processing circuit, and the like.

When reading RFID tags etc., the CPU 11 instructs the RFID communication unit 17 to communicate with the RFID tags etc. via the loop antenna 40 and receive the information stored in these RFID tags etc.

When writing information to the RFID tags etc., the CPU 11 causes the RFID communication unit 17 to send the information to the RFID tags etc. and causes this information to be stored.

The storage unit 18 is a readable/writable memory constituted of a flash memory, EEPROM (electrically erasable programmable read only memory), or the like.

The imaging unit 19 performs imaging and outputs image data in accordance with instructions from the CPU 11. When reading symbols, i.e., the objects of image capture, the imaging unit 19 captures the image of the symbols and generates image data, which the CPU 11 decodes to obtain the information included in the symbols.

The handy terminal 1 may be provided with other antennas and communication units. The handy terminal 1 may include wireless LAN (local area network) and portable mobile communication antennas and communication units or the like, for example.

Next, the configuration of the patch antenna 30 will be explained using FIG. 3.

Figure 5:
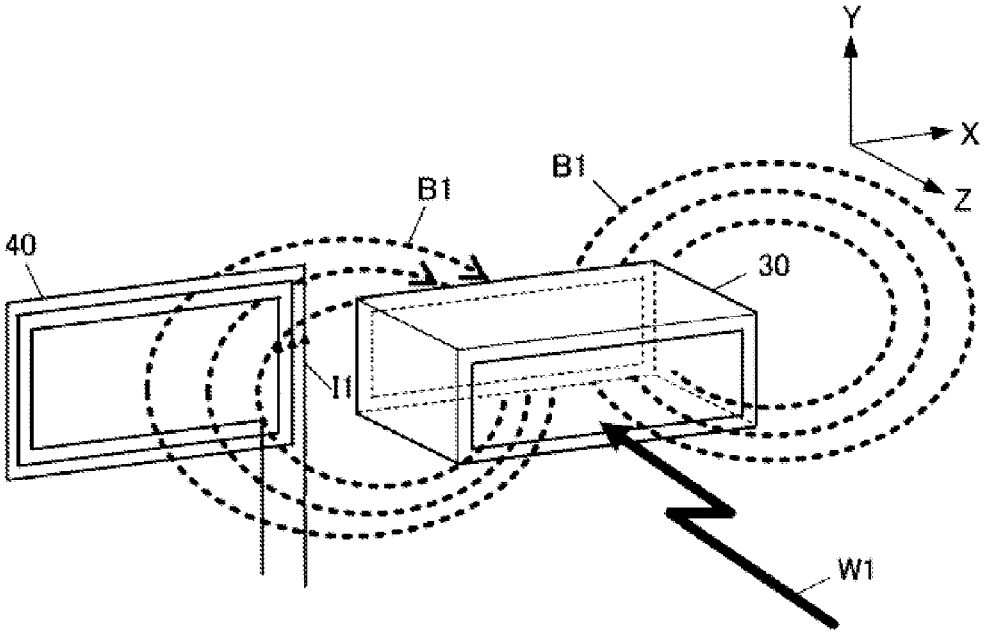
FIG. 5 is a perspective view of magnetic coupling when the patch antenna receives GPS radio waves.
Figure 8A:
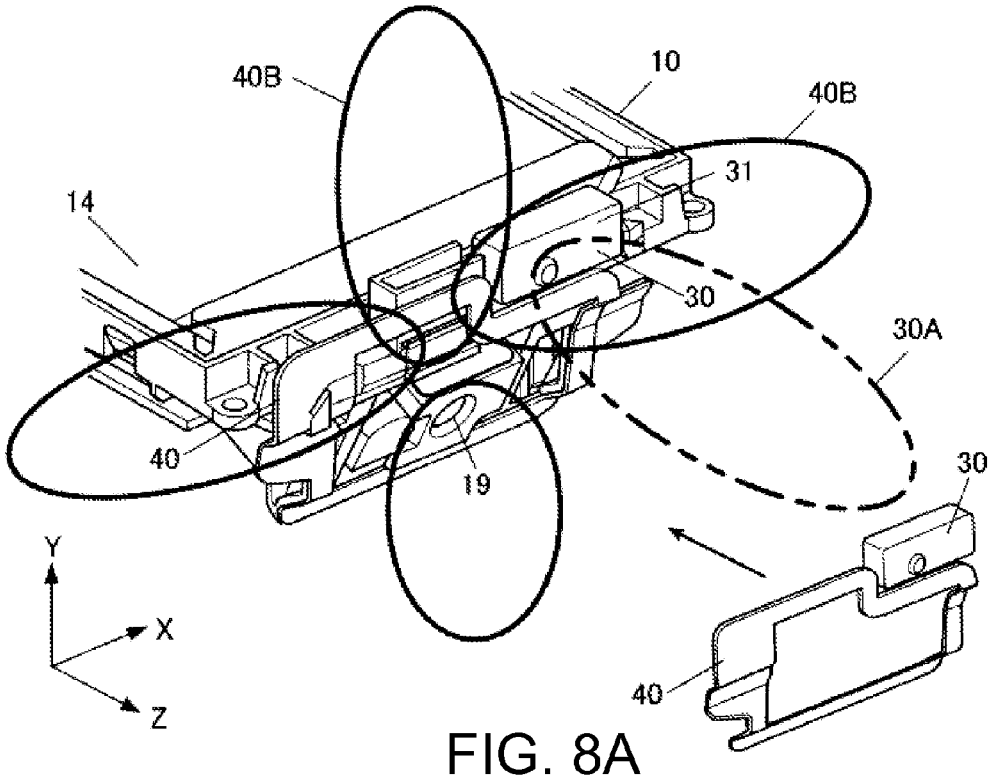
FIG. 8A is a perspective view of the directionality generated by the patch antenna and the loop antenna attached to a substrate.
Figure 8B:
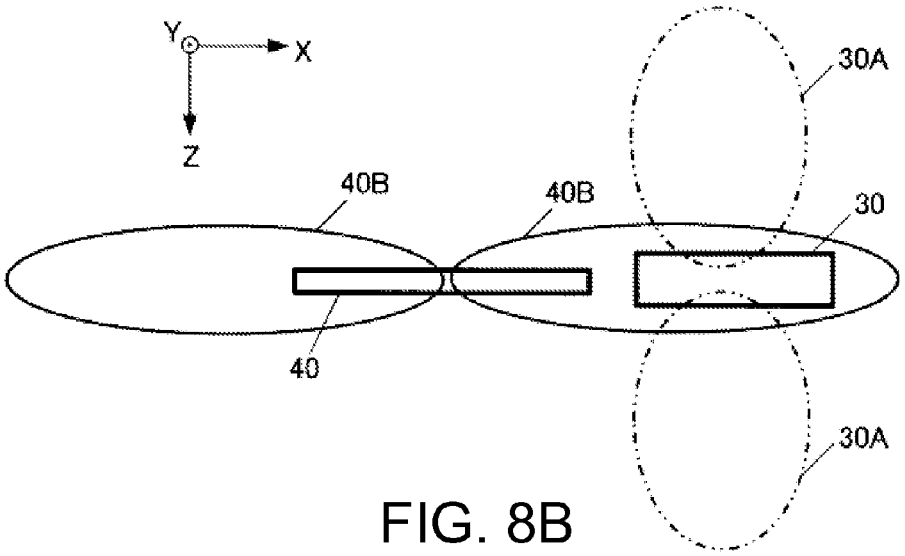
FIG. 8B is a plan view of the directionality generated by the patch antenna and the loop antenna.

For simplicity of explanation, the patch antenna 30 and the loop antenna 40 in FIGS. 3 to 5 are shown with an abbreviated shape. The actual shapes of the patch antenna 30 and the loop antenna 40 are shown in FIGS. 8A and 8B.

The patch antenna 30 includes a surface electrode 31, ground electrode 32, body section 33, and a power supply terminal 34. The surface electrode 31 is a conductor such as silver patterning formed on the top of the body section 33.

The ground electrode 32 is a conductive surface electrode such as copper foil disposed on the bottom of the body section 33. The ground electrode 32 is grounded. The body section 33 is constituted of a dielectric or the like, and has a cuboid shape, for example. The power supply terminal 34 is a conductor that is electrically connected to the surface electrode 31 and disposed so as to penetrate the body section 33. The GPS reception circuit 16*a* is connected to the ground electrode 32 and the power supply terminal 34.

In FIG. 3, the direction perpendicular to the surface electrode 31 (the direction above the patch antenna 30) is the Z axis, the direction parallel to one side (here, in the lengthwise direction) of the top of the patch antenna 30 is the X axis, and the direction parallel to the other side (in the widthwise direction) of the top of the patch antenna 30 and perpendicular to the X axis is the Y axis. A directionality 30A of the patch antenna 30 is represented by two directions in the ±Z direction.

Next, the configuration of the loop antenna 40 will be explained using FIG. 4.

The loop antenna 40 has a conductor part 41. The conductor part 41 is constituted of a conductive (copper foil) pattern formed on an insulating film (not shown).

The configuration of the conductor part 41, however, is not limited to a conductive pattern on an insulating film, and may be wound lead wiring, for example. The RFID driver circuit 17*a* is connected to two conductor terminals of the conductor part 41.

The loop antenna 40 has a loop shape (coil shape) wounded three turns in a substantially rectangular shape, for example. The number of turns that the conductor part 41 is wounded, however, is configured so as to be optimal for RFID magnetism, and thus is not limited to three turns.

In FIG. 4, the axis direction of the loop portion of the conductor part 41 is the Z axis, the direction parallel to one side (here, in the lengthwise direction) of the conductor part 41 is the X axis, and the direction parallel to the other side (in the widthwise direction) of the conductor part 41 and perpendicular to the X axis is the Y axis. A directionality 40B of the loop antenna 40 is represented by the ±X direction and ±Y direction (i.e., four directions) respectively perpendicular to the four sides of the loop portion of the conductor part 41.

Due to the directionality of the loop antenna 40, there is no dependency on the polarization plane of the radio waves, and thus radio waves can be picked up from both vertically polarized waves and horizontally polarized waves. Radio waves can also be picked up from circularly polarized waves, in which the polarization plane rotates.

The line length of one loop of the conductor part 41 is loop length 41L. The loop length 41L is set to one wavelength λ1 of the GPS radio waves. The resonant frequency f1 of the GPS radio waves is 1.5754 GHz; therefore, loop length 41L=c/f1=0.1904 m.

By making the loop length 41L correspond to one wavelength λ1 of the GPS radio waves, standing waves can be caused to be generated at the conductor (element) at the frequency of the GPS radio waves, in a manner similar to a dipole antenna or the like, thereby generating an electric field.

Therefore, the loop antenna 40 can effectively pick up GPS radio waves that are right-handed circularly polarized waves by the above-mentioned loop length 41L and the directionality.

Next, magnetic coupling of the patch antenna 30 and the loop antenna 40 will be explained with reference to FIGS. 5 and 6.

FIG. 5 is a perspective view of magnetic coupling when the patch antenna 30 receives GPS radio waves W1.

Figure 6:
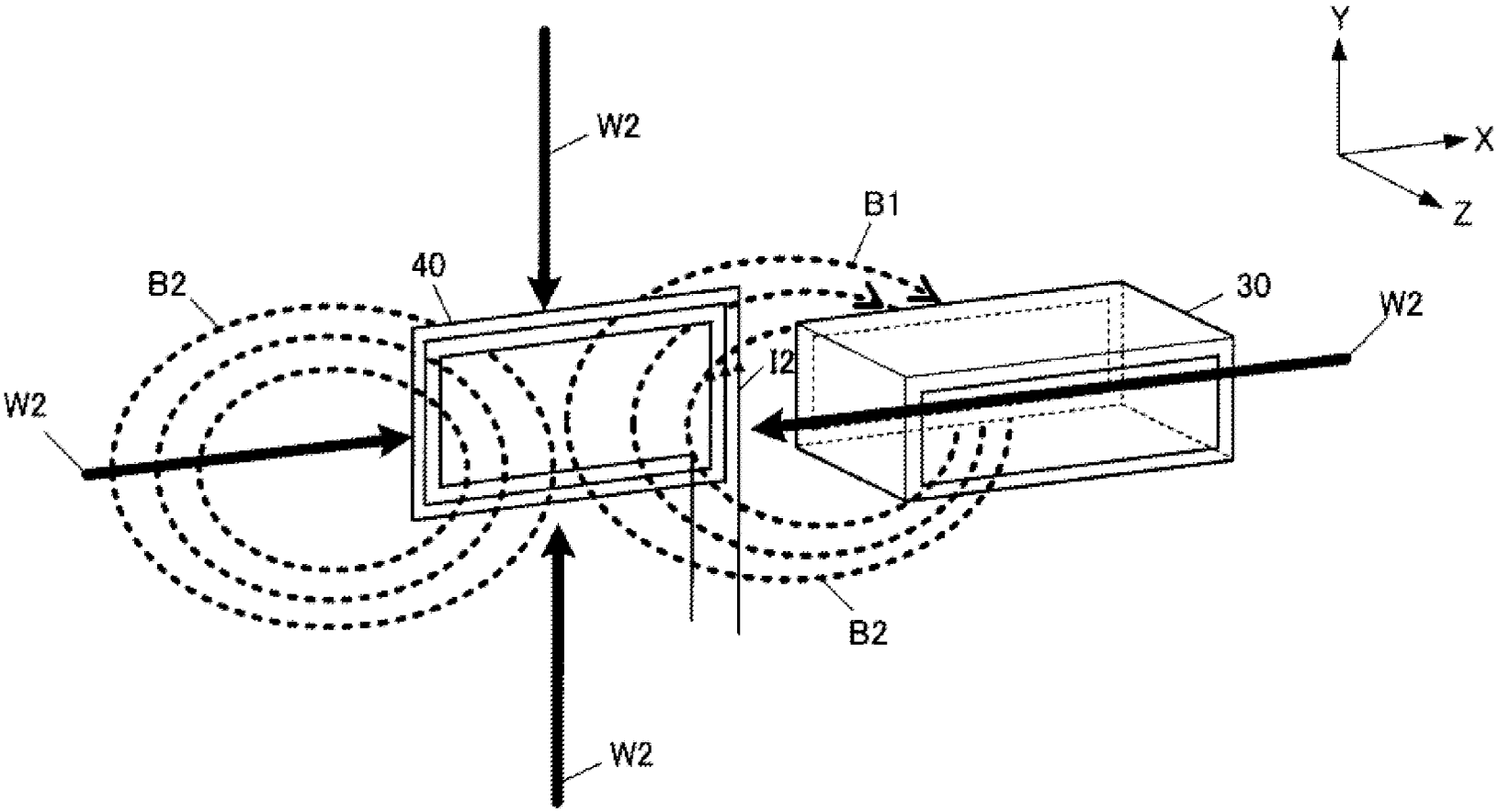
FIG. 6 is a perspective view of magnetic coupling when the patch antenna receives GPS radio waves.

FIG. 6 is a perspective view of magnetic coupling when the loop antenna 40 receives GPS radio waves W2.

An arrangement will be considered in which the direction (Z direction in FIG. 3) perpendicular to the surface electrode 31 of the patch antenna is parallel to the axis direction (Z direction in FIG. 4) of the loop portion of the loop antenna 40, and the patch antenna 30 and the loop antenna 40 are arranged adjacent to each other.

As shown in FIG. 5, a situation is illustrated in which the patch antenna 30 receives the GPS radio waves W1 from the +Z direction corresponding to the directionality 30A of the patch antenna 30.

The patch antenna 30, which is resonating at the frequency (1.5754 GHz) of the GPS radio waves W1, generates a magnetic field B1. The loop portion of the loop antenna 40 is disposed in this generated magnetic field B1 so as to cause the patch antenna 30 and the loop antenna 40 to become magnetically coupled. The magnetic field B1 causes antenna current I1 to flow to the conductor part 41. The antenna current generated by the patch antenna 30 receiving the GPS waves is sent to the GPS reception circuit 16*a*.

Next, as shown in FIG. 6, the loop antenna 40 receives the GPS waves W2 from the +X direction, −X direction, +Y direction, or −Y direction corresponding to the directionality 40B of the loop antenna 40.

The loop antenna 40 receives the GPS waves W2 and generates standing waves in accordance with the loop length 41L at the conductor part 41, which causes antenna current I2 to flow and a magnetic field B2 to be generated. The resonant frequency f2 of the loop antenna 40, however, is 13.56 MHz; therefore, there will be no resonance even if the loop antenna 40 receives the GPS waves W2.

The patch antenna 30 is disposed in a position that magnetically couples with the loop antenna 40 when the GPS waves are received. In other words, the patch antenna 30 is placed in the magnetic field B2 generated by the loop antenna 40. The patch antenna 30 and the loop antenna 40 become magnetically coupled to each other, and thus, after the patch antenna and loop antenna are coupled, the magnetic field B2 arrives at the GPS reception circuit 16*a* as antenna current via the patch antenna 30.

In this manner, the loop antenna 40 also functions as a reception antenna for GPS radio waves. Therefore, the patch antenna 30 and the loop antenna 40 can receive GPS radio waves from the +Z direction, ±X direction, or ±Y direction.

Next, a resonant circuit and equivalent circuit of the loop antenna 40 will be explained with reference to FIGS. 7A and 7B.

Figure 7A:
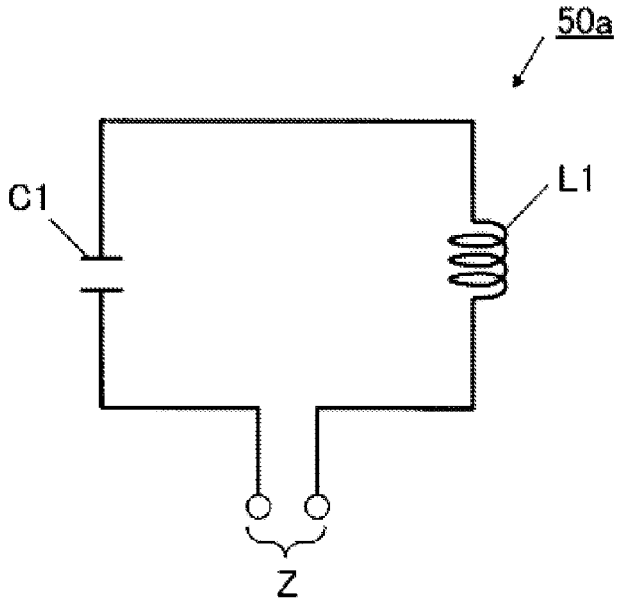
FIG. 7A is a view of a resonant circuit of the loop antenna.

FIG. 7A is a resonant circuit 50*a* of the loop antenna 40.

Figure 7B:
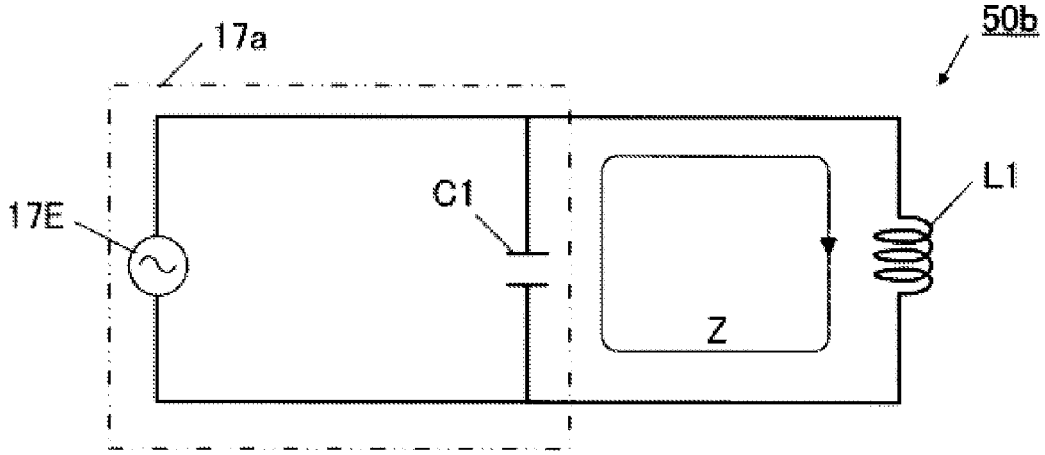
FIG. 7B is an equivalent circuit of the loop antenna and an RFID driver circuit.

FIG. 7B is an equivalent circuit 50*b* of the loop antenna 40 and the RFID driver circuit 17*a*.

The loop antenna 40 resonates due to an RFID electromagnetic field (radio waves). As shown in FIG. 7A, the resonant circuit 50*a* of the loop antenna 40 has a configuration in which a coil L1 corresponding to the loop antenna 40 and a capacitor C1 are connected in series. The resonant circuit 50*a*, which is an LC circuit, resonates at the electromagnetic frequency of the RFID, 13.56 MHz, and at this time serial impedance Z is 0Ω.

Calculation examples for the capacitor C1 in an ordinary RFID circuit will be explained below. In general, an impedance L of a three turn coil is approximately lnH. In order to make this coil resonate at a frequency of 13.56 MHz, a capacitance C of the capacitor C1 is calculated as 0.138 μF in formula (1) below.

$$1/(2\pi\sqrt{LC})=\text{resonant frequency} \quad (1)$$

The circuit shown in FIG. 7B is the equivalent circuit 50*b* of the loop antenna 40 and the RFID driver circuit 17*a*. The equivalent circuit 50*b* has a power source 17E, and the coil L1 and capacitor C1, which are connected in parallel to the power source 17E. The power source 17E and the capacitor C1 are the equivalent circuit of the RFID driver circuit 17*a*.

The equivalent circuit 50*b* resonates by generating a current corresponding to a frequency of 13.56 MHz from the power source 17E. The impedance Z is 0.

The qualify factor of the resonant circuit 50*a* for the resonance frequency f1 and the resonant frequency f2 will be considered below. The Q factor must be small when attempting to induce antenna current at a frequency that is broad enough to both cause the loop antenna 40 to resonate at the resonant frequency f2, thereby inducing antenna current, and to cause antenna current to be induced in the loop antenna 40 at the resonant frequency f1, as in the present embodiment. If the impedance of the coil L1 is lnH, the capacity of the capacitor C1 is 0.138 μF, and the pure resistance of the conductor is 1Ω, then Q will be 0.0851 or a similarly small value.

Furthermore, during reception of radio waves at the resonant frequency f1, there will be demand for the impedance of the loop antenna 40 to be low enough to allow the antenna current, which is induced by the standing waves generated by the loop length 41L, to flow. In the resonant circuit 50*a*, the impedance Z when inducing a current corresponding to 1.575 GHz is calculated as 9.89Ω in accordance with the formula $j\omega L+(1/j\omega C)$. The value of this impedance Z will not hinder antenna current that will generates standing waves in the loop antenna 40.

Next, the antenna directionality of the handy terminal 1 caused by the patch antenna 30 and the loop antenna 40 will be explained with reference to FIGS. 8A and 8B.

FIG. 8A is a perspective view of the directionality generated by the patch antenna 30 and the loop antenna 40 attached to the substrate 10.

FIG. 8B is a plan view of the directionality generated by the patch antenna 30 and the loop antenna 40.

As shown in FIG. 8A, the patch antenna 30 and the loop antenna 40 are attached to the tip of the substrate 10 of the handy terminal 1. The patch antenna 30 is disposed such that the direction perpendicular to the surface electrode is the Z direction. The loop antenna 40 is disposed such that the axis direction of the loop portion is the Z direction. The loop antenna 40 is disposed such that the imaging unit 19 is positioned in the empty portion in the center of the loop.

As shown in FIGS. 8A and 8B, the patch antenna 30 has the directionality 30A in the ±Z direction, as explained in FIG. 3. The loop antenna 40 has the directionality 40B in the ±X direction and the ±Y direction. The loop antenna 40 magnetically couples with the patch antenna 30 when the loop antenna 40 receives GPS radio waves, which causes antenna current to be sent to the GPS reception circuit 16*a* through the patch antenna 30.

In accordance with this principle, the handy terminal 1 can combine the directionality 30A of the patch antenna 30 and the directionality 40B of the loop antenna 40 with respect to GPS radio waves, and has directionalities 30A and 40B in all directions unobstructed by the substrate 10: the +Z direction, the ±X direction, and the ±Y direction.

The GPS satellites are located in the zenith direction of the earth. Therefore, GPS radio waves can be received even when facing the direction of the tip of the handy terminal 1 (+Z direction, the direction perpendicular to the plane of the case (top case 2*a*, bottom case 2*b*) (±Y direction), or the direction perpendicular to the sides of the case (±Y direction).

According to the present embodiment, the handy terminal 1 includes the patch antenna 30, which has a resonant frequency f1 that is a frequency for GPS communication, and the loop antenna 40, which has a resonant frequency f2 that is a frequency for RFID communication. The loop length 41L of the loop antenna 40 is long enough to generate standing waves when the loop antenna 40 receives GPS radio waves. The patch antenna 30 is disposed in a position that magnetically couples with the loop antenna 40.

Therefore, the patch antenna 30 and the loop antenna 40 can be arranged close enough to magnetically couple with each other, the directionality of the patch antenna 30 can be combined with the directionality of the loop antenna 40 with respect to GPS radio waves, and the handy terminal can have directionality that corresponds to many directions, thereby making it possible to increase antenna performance.

Furthermore, the patch antenna 30 and the loop antenna 40 can be made to function after being caused to magnetically couple with each other, thereby making it possible to operate the two antennas, which is not possible with conventional configurations that place the antennas adjacent to each other, and allowing for the antennas inside the handy terminal 1 to be made smaller (denser). The loop length 41L allows for generation of standing waves even without a resonant circuit, which allows for high sensitivity.

In addition, because the loop antenna 40 magnetically couples with the patch antenna 30, the GPS reception circuit 16*a* does not strictly require wiring or circuits for GPS use, and GPS radio waves can be received with a simple structure.

The loop length 41L is one wavelength λ1 of GPS radio waves. Thus, the loop antenna 40 can have a suitable size that corresponds to the handy terminal 1

The patch antenna 30 and the loop antenna 40 are also arranged in a positional relationship whereby the Z direction, which is parallel to the surface electrode 31 of the patch antenna 30, is parallel to the axis direction of the loop antenna 40. This makes it possible to obtain directionality in the +Z direction, the ±X direction, and the ±Y direction.

Furthermore, the resonant frequency of the patch antenna 30 is a frequency for GPS communication, and the resonant frequency of the loop antenna 40 is a frequency for RFID communication. Thus, it is possible to perform RFID communication using the loop antenna 40, and to receive GPS radio waves emitted from the GPS satellites regardless of whichever direction the antenna device ANT (handy terminal) is facing.

Modification Example

Figure 9:
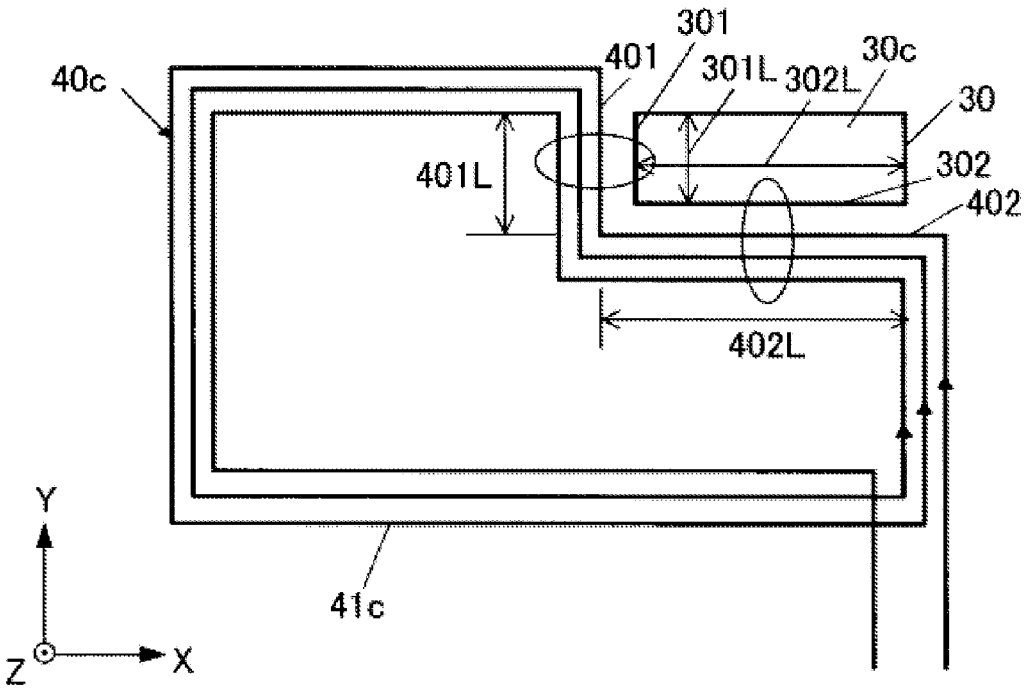
FIG. 9 is a plan view of a loop antenna of a modification example, and the patch antenna.

A modification example of the above-mentioned embodiment will be explained using FIG. 9. FIG. 9 is a plan view of the patch antenna 30 and a loop antenna 40*c*.

The shape of the loop antenna 40 in the above-mentioned embodiment was configured in accordance with attachment point (substrate 10, imaging unit 19, etc.), the shape of the patch antenna 30, the attachment space, and the like.

As shown in FIG. 8A, the patch antenna 30 has, on the loop antenna 40 side thereof, a first patch antenna side that extends in the widthwise direction of the top of the patch antenna 30 (the surface perpendicular to the Z direction), and a second patch antenna side that extends in the lengthwise direction of the patch antenna. The first patch antenna side and the second patch antenna side are adjacent to each other.

The loop antenna 40 has a first loop antenna side adjacent to the patch antenna 30 and extending in the Y direction, and a second loop antenna side that is adjacent to the patch antenna and that extends in the X direction. The first patch antenna side is longer than the first loop antenna side, and the first patch antenna side and the first loop antenna side only partially face each other.

The second patch antenna side is longer than the second loop antenna side, and the second patch antenna side and the second loop antenna side only partially face each other.

Therefore, the patch antenna 30 and the loop antenna 40 cause magnetic coupling primarily between the second patch antenna side and the second loop antenna side, which makes it possible to cause a significant amount of magnetic coupling, thereby allowing for antenna performance to be increased.

The handy terminal 1 of the present modification example does not have an imaging unit, has no constraints on the attachment space for the loop antenna, etc. Therefore, as shown in FIG. 9, the handy terminal 1 has the loop antenna 40*c* instead of the loop antenna 40.

The two adjacent sides on a top 30*c* of the patch antenna 30 are the sides 301 and 302. The length of the side 301 is length 301L. The length of the side 302 is length 302L. The loop antenna 40*c* has an "L"-loop shaped conductor part 41*c*. The loop length of the conductor part 41*c* is the same as the loop length 41L.

The conductor part 41*c* has sides 401 and 402 that are adjacent to each other. The length of the side 401 is length 401L. The length of the side 402 is length 402L. The side 401 is adjacent and parallel to the side 301 of the patch antenna 30. The length 401L is configured so as to be longer than the length 301L.

The side 301 is arranged so as to be within the length 401L of the side 401. The side 402 is adjacent and parallel to the side 302 of the patch antenna 30. The length 402L is configured so as to be longer than the length 302L. The side 302 is arranged so as to be within the length 401L of the side 402.

As shown by the elliptical portions in FIG. 9, magnetic coupling is generated between the side 301 and the side 401 and between the side 302 and the side 402. Therefore, the magnetic field generated when the loop antenna 40*c* receives GPS radio waves is more effectively transmitted to the patch antenna 30 than the magnetic field of the loop antenna 40.

Thus, the magnetic coupling of the patch antenna 30 and the loop antenna 40*c* is stronger than the magnetic coupling of the patch antenna 30 and the loop antenna 40.

According to the modification example described above, the loop antenna 40*c* has the side 401, which is longer than the length 301L of the side 301 of the top 30*c* of the patch antenna 30 and which is adjacent and parallel to this side 301, and the side 402, which is longer than the length 302L of the side adjacent to the side 301 and which is adjacent and parallel to this side 302. Therefore, it is possible to make the magnetic coupling of the patch antenna 30 and the loop antenna 40*c* stronger than the magnetic coupling of the patch antenna 30 and the loop antenna 40, which allows for the generated magnetic fields to be efficiently picked up by the patch antenna 30 when GPS radio waves are received by the loop antenna 40*c*.

The descriptions of the above-mentioned embodiment and the modification example above is one example of an antenna device and a portable electronic device according to one aspect of the present invention, and the present invention is not limited to this.

In the above-mentioned embodiment and modification example, the handy terminal 1 was the portable electronic device, but the present invention is not limited to this, for example.

A smartphone, PDA (personal digital assistant), or other device may be used as the portable electronic device.

Furthermore, in the above-mentioned embodiment and modification example, the resonant frequency of the patch antenna 30 was a frequency used for GPS communication, and the resonant frequency of the loop antenna 40 and 40*c* was a frequency used for RFID communication, but the present invention is not limited to this.

The resonant frequency (first frequency) of the patch antenna and the resonant frequency (second frequency) of the loop antenna may be a different frequency.

The patch antenna may be an antenna for a wireless LAN communication scheme while the loop antenna is for RFID use, and the first frequency may be 2.4 GHz (band) for wireless LAN communication. Even with this configuration, the directionality of the antenna for wireless LAN communication can be broadened.

The impedance of the loop antenna during reception of radio waves in the first frequency, however, should be low enough to allow antenna current caused by stationary waves generated by the loop length to flow. It is necessary for the Q factor of the loop antenna to be lowered in order to allow antenna current to flow to the loop antenna within the first frequency and the second frequency.

In the embodiment and the modification example described above, the loop length 41L of the loop antennas 40 and 40*c* is one wavelength of the resonant frequency of the patch antenna 30, but the present invention is not limited to this. In accordance with installation space and the like for the patch antenna and the loop antenna, the loop length of the loop antenna may be n times or ½ m times (n, m: integers) the wavelength λ1 of the resonant frequency of the patch antenna 30, or preferably ½ times or ¼ times the wavelength λ1.

The detailed configuration and operation of the respective constituting elements of the handy terminal 1 in the above-mentioned embodiment and modification example can be modified as appropriate without departing from the spirit of the invention.

An embodiment and modification example of the present invention were described above, but the scope of the present invention is not limited to the above-mentioned embodiment and modification example, and includes the claims of the invention and equivalent claims thereof described in the section of the claims. In particular, it is explicitly contemplated that any part or whole of any two or more of the embodiments and their modifications described above can be combined and regarded within the scope of the present invention.

What is claimed is:

1. An antenna device, comprising:

a patch antenna for global positioning system (GPS) communication, having a resonant frequency at a first frequency that is used for GPS communication; and a loop antenna for radio-frequency identification (RFID) communication, having a resonant frequency at a second frequency that is different from the first frequency and that is used for RFID communication, wherein a loop length of the loop antenna is such that standing waves are generated in the loop antenna when the loop antenna receives radio waves of the first frequency, and wherein the patch antenna is disposed at a position that is located outside of an area enclosed by the loop antenna as seen in a plan view of the loop antenna such that the patch antenna magnetically couples with the loop antenna, thereby causing the loop antenna to also function as an antenna for GPS communication.

2. The antenna device according to claim 1, wherein the loop length of the loop antenna is n times or ½ m times (n, m: integers) a wavelength corresponding to the first frequency.

3. The antenna device according to claim 1, wherein the patch antenna and the loop antenna are arranged such that a direction perpendicular to a surface electrode of the patch antenna is parallel to an axis direction of a loop portion of the loop antenna.

4. The antenna device according to claim 1, wherein the patch antenna has a first patch antenna side and a second patch antenna side that are adjacent to each other, and wherein the loop antenna has a first loop antenna side that is parallel and adjacent to the first patch antenna side of the patch antenna and longer than said first patch antenna side, and a second loop antenna side that is parallel and adjacent to the second patch antenna side of the patch antenna and longer than said second patch antenna side.

5. A portable electronic device, comprising:

the antenna device according to claim 1;

a first antenna communication unit that performs wireless communication via the patch antenna using the first frequency; and a second antenna communication unit that performs wireless communication via the loop antenna using the second frequency.

6. A portable electronic device, comprising:

an imaging unit provided on an end of the portable electronic device;

a loop antenna for radio-frequency identification (RFID) communication, provided so as to surround the imaging unit; and a patch antenna for global positioning system (GPS) communication, having a different resonant frequency than a resonant frequency of the loop antenna, wherein a loop length of the loop antenna is such that standing waves are generated in the loop antenna when the loop antenna receives radio waves having a frequency that corresponds to the resonant frequency of the patch antenna, and wherein the patch antenna is disposed at a position that is located outside of an area enclosed by the loop antenna as seen in a plan view of the loop antenna such that the patch antenna magnetically couples with the loop antenna, thereby causing the loop antenna to also function as an antenna for GPS communication.

7. The antenna device according to claim 1, wherein the patch antenna has a first patch antenna side and a second patch antenna side that are adjacent to each other, and wherein the loop antenna has a first loop antenna side that is adjacent to the first patch antenna side of the patch antenna and shorter than said first patch antenna side, and a second loop antenna side that is adjacent to the second patch antenna side of the patch antenna and shorter than said second patch antenna side.

* * * * *